US008747581B2

(12) United States Patent
Borne

(10) Patent No.: US 8,747,581 B2
(45) Date of Patent: Jun. 10, 2014

(54) PARTICLES OF AN EXPLOSIVE OF LOW SENSITIVITY TO SHOCK AND ASSOCIATED TREATMENT PROCESS

(75) Inventor: Lionel Borne, Saint Louis Cedex (FR)

(73) Assignee: Institut Franco-Allemand de Recherches de Saint-Louis, Saint Louis (FR)

( * ) Notice: Subject to any disclaimer, the term of this patent is extended or adjusted under 35 U.S.C. 154(b) by 1173 days.

(21) Appl. No.: 11/445,146

(22) Filed: Jun. 2, 2006

(65) Prior Publication Data

US 2006/0272755 A1 Dec. 7, 2006

(30) Foreign Application Priority Data

Jun. 2, 2005 (FR) ..... 05 05578

(51) Int. Cl.
*C06B 25/34* (2006.01)
*C06B 45/02* (2006.01)

(52) U.S. Cl.
USPC ..... 149/92; 149/109.6; 149/124; 540/556; 544/18

(58) Field of Classification Search
USPC ..... 544/180; 540/556; 149/92, 109.5, 124, 149/109
See application file for complete search history.

(56) References Cited

U.S. PATENT DOCUMENTS

| | | | |
|---|---|---|---|
| 4,065,529 | A | 12/1977 | Lavertu et al. |
| 4,638,065 | A | 1/1987 | Svensson et al. |
| 6,194,571 | B1 | 2/2001 | Lukasavage |
| 6,428,724 | B1 | 8/2002 | Lukasavage et al. |
| 6,603,018 | B2 | 8/2003 | Highsmith et al. |

FOREIGN PATENT DOCUMENTS

| | | | |
|---|---|---|---|
| DE | 36 05 634 | A1 | 8/1987 |
| EP | 1 256 558 | A2 | 11/2002 |

OTHER PUBLICATIONS

Borne, Lionel, et al. "Quantitative Characterization of Internal Defects in RDX Crystals" Propellants, Explosives, Pyrotechnics, 1999, Wiley-VCH, Verlag GMBH, Weinheim, GER, vol. 24, No. 4, pp. 255-259, XP008061081, p. 259.

Choong, K.L., et al. "Optimization of Batch Cooling Crystallization" Chem. Eng. Sci.; Chemical Engineering Science, Jan. 2004, vol. 59, No. 2, Jan. 2004, pp. 313-327, XP002371106.

Gutwald, Thomas, et al. "Batch Cooling Crystallization at Constant Supersaturation: Technique and experimental results" Chem Eng Technol; Chemical Engineering & Technology, Aug. 1990, vol. 13, No. 4, Aug. 1990, pp. 229-237, XP002371107.

Choi, Cheong-Song, et al. "Controlled Cooling Crystallization of (NH4)2S04 in the Ternary System (NH4)2S04-NH4N03-H20" Ind Eng Chem Res; Industrial & Engineering Chemistry Research, Jul. 1991, vol. 30, No. 7, Jul. 1991, pp. 1588-1593, XP002371108.

Kroeber, H., et al. "Production of HMX Crystals with High Internal Quality by Cooling Crystallization" p. 812, XP000786232, Abstract, Chemical Abstracts, vol. 129, No. 11, Sep. 14, 1998, Columbus, Ohio, US; abstract No. 138139r & Int. Annu. Conf. ICT 1998, (29$^{th}$ (Energetic Materials), 1998, pp. 66.1-66.18.

Meulenbrugge, J., et al. "Crystallization of Energetic Materials; The Effect on Stability, Sensitivity and Processing Properties" p. 731, XP000749116, Abstract, Chemical Abstracts, vol. 128, No. 10, Mar. 9, 1998, Columbus, Ohio, US; abstract No. 117022m, & Proc.—Int. Symp. Energ. Mater. Technol. 1995, 1995, pp. 297-302.

Matsuzaki et al., "Reduced Sensitivity RDX (RS-RDX): Effects of crystal quality and shape on the shock sensitivity of RS-RDX based PBXN-109 formulation," R & D Division, Nippon Koki Co., Ltd., pp. 1-10 (2007).

Borne et al., "From RS-RDX to VI-RDX: A New Step," French-German Research Institute of Saint-Louis (ISL), Saint-Louis, France, pp. 1-15 (2007).

*Primary Examiner* — Venkataraman Balasubramanian
(74) *Attorney, Agent, or Firm* — Oliff PLC

(57) ABSTRACT

The invention relates to the field of explosives, and more particularly relates to particles of an explosive, wherein they are in crystalline form, have a rounded shape and a majority of them contain no internal defect. Particles of an explosive in crystalline form include a volume fraction of closed pores of less than or equal to 0.05%. A method for preparing explosive particles includes preparing crystalline particles, a majority of which are without an internal defect; and rounding the crystalline particles.

18 Claims, 5 Drawing Sheets

Sensitivity of various batches of granular hexogen

PARTICLES OF AN EXPLOSIVE OF LOW SENSITIVITY TO SHOCK AND ASSOCIATED TREATMENT PROCESS

INCORPORATION BY REFERENCE

The disclosure of French Patent Application No. 05/05578 filed on Jun. 2, 2005, including the specification, drawings and abstract, is incorporated herein by reference in its entirety.

BACKGROUND

The present invention relates to the field of explosives, and more particularly relates to particles of an explosive and a process for obtaining such particles.

There exists explosive particles, such as, for example, nitramines (RDX, HMX etc.) or CL20, that have a variable sensitivity to shock. It is also known that for conventional nitramines (RDX, HMX), the lowest sensitivity of explosive formulations to shock is obtained with particles of very small sizes, typically particles having sizes between 0 and 10 μm. However, the use of these very small particles in cast formulations is difficult because of the high viscosity of the mixtures.

In the context of these formulations, it is also preferable to use particles having sizes greater than 100 μm in order to reduce the viscosity of the mixtures. However, the exposure to the risk of explosion is greater as size of the particles increases, the higher the sensitivity to shock.

U.S. Pat. No. 4,065,529 describes a process that enables the viscosity of particles to be reduced. The process consists of treating the particles by stirring and partial dissolving to render them spherical, this process being carried out on particles having a size greater than 70 μm.

Techniques that enable the sensitivity of nitramines to shock are furthermore known. U.S. Pat. No. 6,603,018 describes the synthesis of a nitramine compound that contains one or more N-heterocyclomethyl functions that give it high energy performances while rendering it less sensitive to shock than nitramines, which do not have such functions.

U.S. Pat. No. 6,194,571, which, in this same point of view, proposes the synthesis of the alpha-HMX structure, which is less sensitive to shock than the beta-, delta- and gamma-HMX crystalline structures.

U.S. Pat. No. 6,428,724 moreover proposes coating and agglomeration of elementary particles of nitramines in the form of granules to facilitate the use in explosive formulations, in particular, if the elementary particles are elongated in shape. Coating is a conventional technique for reducing the sensitivity of explosive formulations to shock, but this does not reduce the intrinsic sensitivity of elementary particles.

The document "Optimization of batch cooling crystallization" by Choong and Smith published in Chemical Engineering Science, describes a process for the preparation of crystalline particles by nucleation and crystalline growth consisting of cooling a supersaturated solution of a product suitable for formation of these particles with a cooling in $t^4$ without seeding and in $t^3$ with seeding.

However, this process enables the size of the particles to be controlled, but the particles have numerous internal defects. The use of this process for the preparation of explosive crystalline particles would lead to particles having a high sensitivity to shock being obtained.

EP 1256558 describes a method for the preparation of crystalline particles by nucleation and crystalline growth consisting of cooling, in the presence of ultrasound, a supersaturated solution of a product suitable for formation of these particles with a cooling of the order of 0.3° C./min. The presence of ultrasound enables the control of the size of the particles to be improved, in particular a reduction in the width of the size distribution, and enables the need for seeding and therefore the defects and gaps which appear at the renewal of a growth on the nuclei used for the seeding to be avoided. However, this process enables neither suppression nor limitation of defects due to inclusions of solvent, which are the main defects observed both with a process according to Choong and with a process according to EP 1256558. The particles obtained thus have a significant sensitivity to shock.

SUMMARY

The invention thus provides, among other things, particles of an explosive that have an insensitivity to shock which is clearly greater than those obtained with the abovementioned processes, and the use of which in cast formulations is easy. In other words, the sensitivity to shock does not depend on size. Furthermore, the process does not necessitate an intermediate step of granulation or coating.

According to an exemplary aspect of the invention, particles of an explosive in crystalline form have a volume fraction of closed pores of less than or equal to 0.05%.

To obtain such a result, the majority of particles do not have internal defects due to inclusions of solvent or to a renewal of growth on nuclei.

The volume fraction of closed pores in a body of particles is determined by the following formula:

$$f_v = \frac{\rho_{part} - \rho}{\rho_{part} - \rho_{pores}}$$

where $f_v$: volume fraction of closed pores $\rho_{part}$: density of the material which makes up the particles. For hexogen (RDX): 1.801 g/cm$^3$ $\rho_{pores}$: density of the material which makes up the pores For our invention: 0 g/cm$^3$ (empty pores)

$\rho$: corrected density as a function of heterogeneities $$\frac{1}{\rho} = \frac{1}{fm_{part}}\left[\frac{1}{<\rho>} - \sum_j \frac{fm_j}{\rho_j}\right]$$

$fm_{part}$: mass fraction of the material which makes up the particles $$\frac{1}{<\rho>} = \sum_{i=1}^{n} \frac{fm_i}{\rho_i}$$

mean apparent density of the particles.

The pairs (fm, $\rho_i$) (i=1 to n) are determined by a measurement of the distribution of the apparent density of the particles, which sorts the initial body of particles into n classes of mean apparent density $\rho_i$ and mass fraction $fm_i$. Preferably, this measurement is carried out in accordance with the method described in French Patent Application No. 0603261 filed by the Applicant and included by reference in its entirety.

$fm_i$: mass fraction of the material of heterogeneities j $\rho_i$: density, of the material of heterogeneity j.

In the case of particles of hexogen (RDX), the most frequent heterogeneity is the presence of octogen (HMX). The mass fraction of HMX can be measured by HPLC liquid chromatography. In this case, $\rho_j=\rho_{hmx}=1.902$ g/cm$^3$.

According to a characteristic that also allows a reduction in the sensitivity of these particles to shock, the particles are rounded in shape.

The combination of these two characteristics allows the sensitivity to shock to be dissociated from the size of the particles, in particular for particles of which the size is between 50 and 1,000 μm.

According to another exemplary aspect of the invention, the rounded particles have a shape of a sphere, a capsule or a pebble.

According to another exemplary aspect of the invention, the particles of the explosive are in crystalline form.

According to another exemplary aspect of the invention, the size of the particles is between 70 and 1,000 μm, and preferably greater than 100 μm.

According to another exemplary aspect of the invention, a method for preparing explosive particles includes a step of preparing crystalline particles, a majority of which have no internal defect, and a step suitable for rounding the crystalline particles.

According to another exemplary aspect of the invention, the step of preparing the crystalline particles includes a first step of nucleation achieved by controlled cooling of a saturated solution of a product which is suitable for formation of explosive crystalline particles, and then a second step of crystalline growth achieved by controlled cooling while maintaining a supersaturation of the product.

During the first step, control of the rate of cooling enables control of the final size of the particles. The aim of this step is to give rise to seeds that will support the subsequent crystalline growth. Preferably, there is no introduction of external nuclei, in order to avoid the occurrence of internal defects during the renewal of the crystalline growth on these external seeds.

According to another exemplary aspect of the invention, when using a saturated acetone solution of hexogen, the rate of cooling during the first step is 1° C./min, preferably from a temperature of 50° C., up to a temperature of 44° C.

According to an additional characteristic, the aim of the second step of crystalline growth is to cause the nuclei prepared during the first step to grow, limiting to the maximum internal defects in the crystals, such as inclusions of solvents. This is achieved by keeping the supersaturation constant and low throughout the process. According to a particular characteristic, control of the supersaturation during the second step is achieved by a cooling for which the temperature T approximately follows, as a function of the time t expressed in seconds, a course expressed by the following equation:

$$T=T0-T1\cdot(t/3{,}600)^3,$$

where T0 is the starting temperature and T1 is the difference in temperature between T0 and the final temperature, these two values being able to have values, by way of example, of 44 and 24 respectively in the case of a solution of acetone and hexogen.

According to another exemplary aspect of the invention, preparing crystalline particles comprises a third step of filtrating the explosive crystalline particles obtained.

According to another exemplary aspect of the invention, the step that is suitable for rounding the crystalline particles includes mechanical erosion combined with partial dissolving of the crystalline particles.

According to another exemplary aspect of the invention, if the crystalline particles are particles of hexogen, the partial dissolving is carried out in cyclohexanone.

BRIEF DESCRIPTION OF THE DRAWINGS

Other advantages and characteristics of the invention will appear in the description of a particular embodiment of the invention and with regard to the attached figures, in which.

DETAILED DESCRIPTION OF EMBODIMENTS

A process for the preparation of particles of an explosive according to the invention comprises a step of crystallizing particles suitable for reducing populations of internal defects in particles, as well as a subsequent step suitable for modifying the shape of the particles in order to round them.

Figure 8:
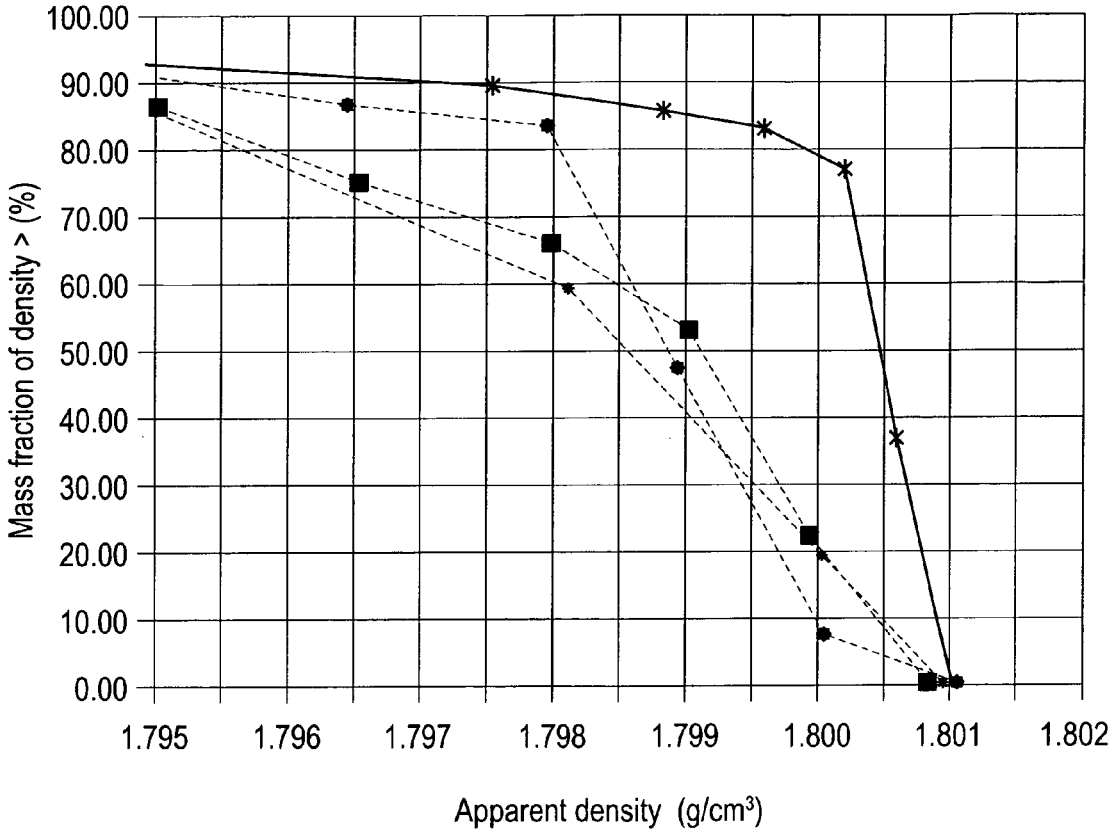
FIG. 8 shows the mass fraction of particles as a function of the apparent density of the particles for three commercial batches.

The crystallization step for reducing the internal defects of the particles is achieved by controlled a cooling of a saturated solution without seeding. Rapid cooling ensures abundant nucleation, which controls the particle size distribution. This first step is followed by a controlled cooling that enables growth of the crystals without internal defects. The temperature during the growth of the crystals is controlled in order to maintain a constant supersaturation. The shape of the particles obtained is characteristic of the crystalline nature of the material. The particles have very marked facets and angles, but very few internal defects. FIG. 8 shows the mass fraction of particles as a function of the apparent density of the particles for three commercial batches L1, L2 and L3, known by the Applicant as being the best commercial batches to date, and a batch L4 obtained using the process according to the invention. It is found that about 80% of the particles according to the invention have an apparent density greater than or equal to 1.800, whereas for the commercial batches L1, L2 and L3 less than 25% of the particles have an apparent density greater than or equal to 1.800. The mean density of the particles according to the invention is thus clearly higher than that of the particles of the commercial batches, which corresponds to a volume fraction of closed pores of less than 0.05% in the context of the invention, whereas it is always greater than 0.1% for the commercial batches.

The quality of the crystals can be checked by optical microscopy with the immersion of the particles in a liquid of high refractive index, typically of the order of 1.6 for hexogen particles. This check reveals internal defects in the particles as darker spots inside the particles.

The step of modifying the shape of the crystals is carried out by mechanical erosion and partial dissolving in an undersaturated solvent. This last preparation step does not change the populations of internal defects of the particles. The shape of the particles can be checked on the one hand from the optical microscopy slides and on the other hand from the scanning electron microscopy slides.

The particles of explosive obtained, the size of which is generally between 50 and 100 μm, have exceptional performances. The very low sensitivity of these particles of an explosive to shock is equivalent only to that obtained with particles of very small size. The particles of an explosive that are produced by a process according to the invention have this very low sensitivity independently of their size. This surprising dissociation between the sensitivity of the particles of an explosive to shock and their size enables the size distribution of the particles to be optimized in order to facilitate their use without compromising their sensitivity to shock. An increased safety in use, an increased ease of use and a reduced sensitivity to shock are significant industrial benefits.

By way of example of the use of the invention, a process for the preparation of crystalline particles of hexogen according to the invention will not be described.

Figure 6:
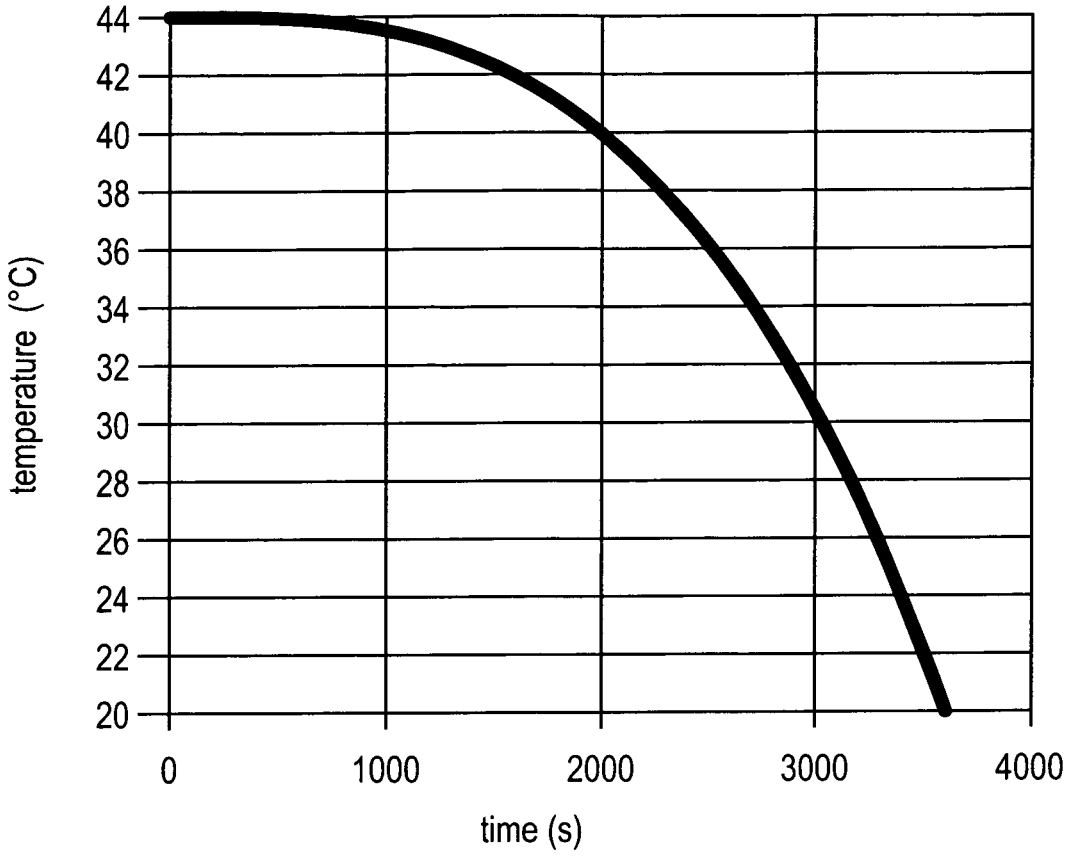
FIG. 6 shows an example of a controlled cooling curve of a solution that is suitable for formation of particles of hexogen by crystalline growth.

A saturated solution of hexogen in acetone is prepared at 50° C. This solution is placed in a double-walled cylindrical container to control the temperature of the solution. An internal tube is placed inside the cylindrical container to achieve homogeneous flow of the solution. Stirring of the solution is carried out conventionally with the aid of a central propeller. This type of device is commonly used for batch crystallization operations. It ensures thermal and hydrodynamic homogeneity of the solution. The saturated solution is cooled rapidly from 50° C. to 44° C. at a rate of 1° Celsius per minute to achieve nucleation. The growth of the hexogen crystals is then realized by controlled cooling of the system between 44° C. and 20° C. This controlled cooling is carried out by following equation curve:

$$T=44-24(t/3{,}600)^3$$

where T is the temperature, expressed in degrees Celsius, and t is the time, expressed in seconds. This course is shown on FIG. 6. The aim of this control of the temperature is to maintain a constant supersaturation during the cooling. The mixture is finally discharged on a filter in order to collect the particles.

Figure 1:
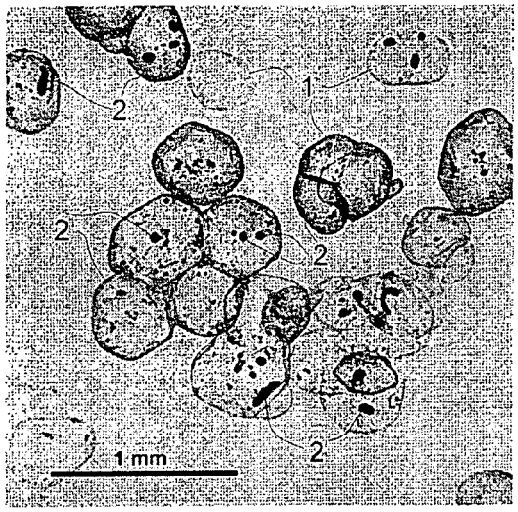
FIG. 1 shows a slide of commercial particles of hexogen obtained with an optical microscope and with a reduction of the contrast on the particles.

As shown on FIG. 1, which is a slide obtained by optical microscopy, with a reduction of the contrast, of commercial particles of hexogen immersed in a liquid of refractive index 1.6, these commercial particles 1 almost all contain small dark spots 2 characteristic of internal structural defects.

Figure 2:
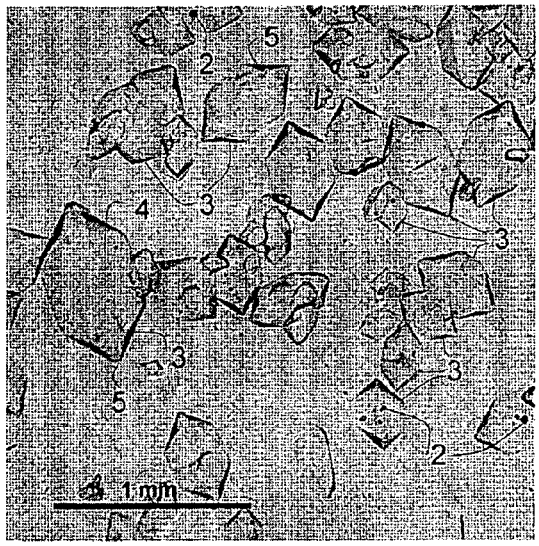
FIG. 2 shows a slide of crystalline particles of hexogen after growth of crystals without an internal defect and before the step that is suitable for rounding them, obtained with an optical microscope and with a reduction of the contrast on the particles.

By comparison, FIG. 2 shows a slide obtained by optical microscopy, with a reduction of the contrast, of crystalline particles of hexogen prepared with the abovementioned process. The particles 3 obtained in this way are angular and have very pronounced facets 4 and angles or edges 5. In addition, it is found that the majority of them are free from internal structural defects 2 under these visualization conditions, which are analogous to those of FIG. 1. The angular shape of the particles is even more visible on the slide of FIG. 3 obtained with the aid of a scanning electron microscope.

Figure 3:
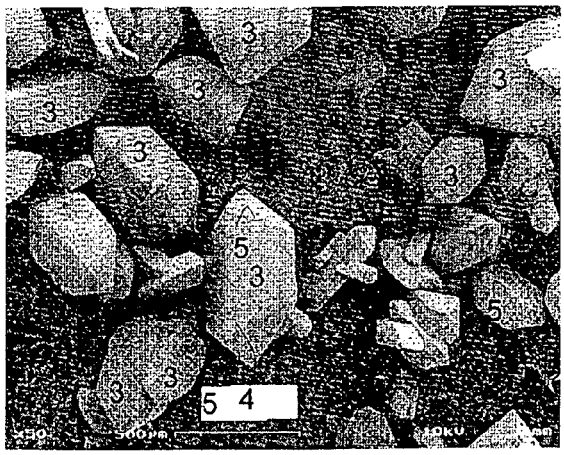
FIG. 3 shows a slide of these same particles of hexogen without internal defect and before the step that is suitable for rounding them, obtained with a scanning electron microscope.

The hexogen particles obtained by the abovementioned crystallization process and shown on FIGS. 2 and 3 are then treated in order to give them a rounded shape. This treatment consists of a mechanical erosion and partial dissolving in cyclohexanone. For this, a saturated solution of hexogen (RDX) in cyclohexanone is prepared at 20° C. The hexogen particles of which the shape is to be modified are added to the saturated solution to form a homogeneous suspension. This mixture is placed in a double-walled container in order to control the temperature. The container is equipped with a propeller stirrer to ensure vigorous stirring of the system. Two baffles are added to the container and form obstacles to movements of the particles and enable them to be eroded. The temperature of the system is then brought to 39° C. This temperature is maintained for 4 hours for partial dissolving of the particles and alteration in their shape. To finish, the temperature is brought to 59° C. for one hour in order to dissolve completely the very fine particles produced by mechanical erosion of the initial particles. The cyclohexanone/particles mixture is then discharged on a filter to collect the hexogen particles.

Figure 4:
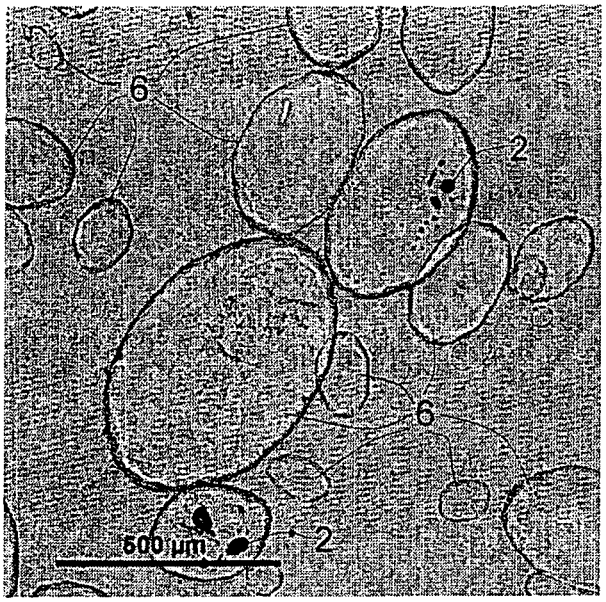
FIG. 4 shows a slide, obtained with an optical microscope with a variation of the contrast on the particles, of particles of hexogen according to the invention.

This last preparation stage does not change the number of internal defects of the particles, as shown by FIG. 4.

Figure 5:
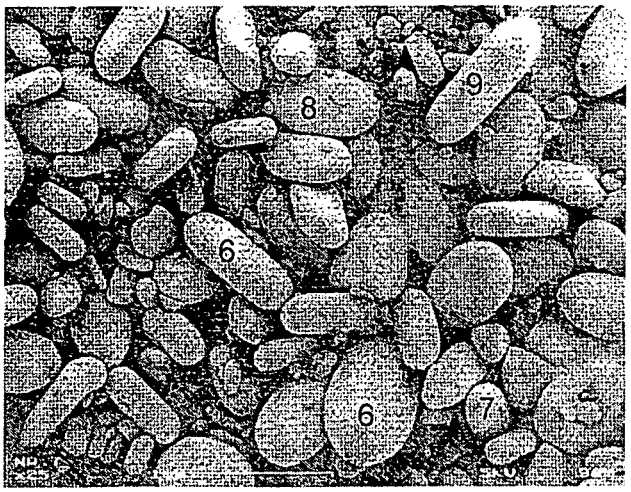
FIG. 5 shows a slide of particles of hexogen according to the invention obtained with a scanning electron microscope.

FIG. 5 shows a slide, obtained with a scanning electron microscope, of hexogen particles 6 which have been subjected to a mechanical erosion with partial dissolving. It is found that they all have a rounded shape with neither edge nor facet, either in the shape of a sphere 7 or in the shape of a pebble 8 or in the shape of a capsule 9. All the edges have been suppressed by this treatment.

The sensitivity of the hexogen particles is evaluated by measuring the sensitivity of cast formulations to shock. These formulations are composed of 70% by weight of hexogen and 30% of wax. These proportions enable formulations which are free from residual porosity in the wax or at hexogen-wax interfaces to be prepared.

The sensitivity of the formulations to shock is determined by a measurement of the minimum pressure under shock necessary to obtain complete detonation of the sample, the incident shock being maintained in the course of time.

Figure 7:
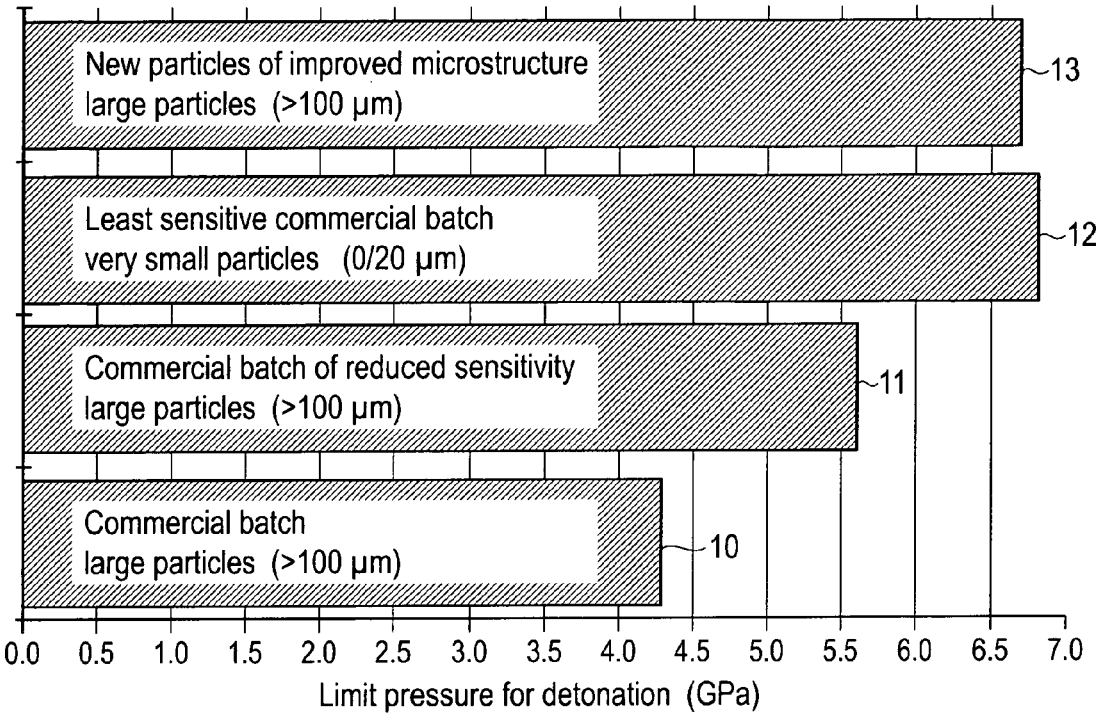
FIG. 7 shows the limit pressure for detonation of various batches of particles of hexogen.

The graph of FIG. 7 shows the limit pressure for detonation, and thus the sensitivity to shock, for four different batches of hexogen particles. The first commercial batch 10 is a standard batch comprising particles having sizes greater than 100 μm. The second batch is a commercial batch 11 similar to the first but leading to formulations of reduced sensitivity. It corresponds to better performances compared to a commercial batch comprising large particles. The third commercial batch 12 is composed of particles having sizes between 0 and 20 μm. It corresponds to better performances compared to a commercial batch of hexogen. Batch 13 is composed of particles according to the invention having sizes between 100 μm and 630 μm.

It is found that the batch composed of particles according to the invention detonates at a pressure of the order of 6.7 Gpa, whereas for particles of similar sizes (batches 10 and 11), this pressure is at best 5.6 Gpa. The particles 6 according to the invention are thus much less sensitive to shock than the particles of the same size which are commercially available.

Subsequently, it is found that the particles according to the invention have a limit pressure for detonation which is virtually identical to that of batch 12 which comprises only particles of small size, that is to say the size of which is less than 20 μm, which clearly shows the benefit of the invention since, in addition to its increased insensitivity to shock, the particles according to the invention can be easily cast because of their relatively large size and their rounded shape.

Thus, in the context of the invention, having a first step of nucleation with rapid cooling, chiefly greater than 0.5° C. per minute, and a second step of crystalline growth with a cooling which is first slow and then rapid, chiefly in $T^3$, enables particles having virtually no defect and having a volume fraction of closed pores of less than or equal to 0.05% to be obtained.

Numerous modifications can be made to the embodiment described without deviating from the scope of the invention. The process for treatment of the form of the particles of explosive can thus be carried out, in particular, by a mechanical route, by a chemical route or by a combination of the two. Furthermore, the invention relates not only to the group of nitramines, but also to all explosive particles having, in their crystalline form, internal defects, facets and edges.

The invention claimed is:

1. Particles of nitramine in crystalline form comprising a volume fraction of closed pores of less than or equal to 0.05%.

2. The particles of nitramine according to claim 1, wherein the particles have a rounded shape.

3. The particles of nitramine according to claim 2, wherein the nitramine is RDX.

4. The particles of nitramine according to claim 3, wherein a size of the rounded particles is between 70 and 1,000 μm.

5. The particles of nitramine according to claim 4, wherein the size of the rounded particles is greater than 100 μm.

6. A method for preparing explosive nitramine particles comprising:

preparing crystalline nitramine particles, a majority of which are without an internal defect; and rounding the crystalline nitramine particles.

7. The method according to claim 6, wherein preparing the crystalline nitramine particles comprises:

a first step of nucleation achieved by controlled cooling of a saturated solution of a product suitable for formation of explosive crystalline nitramine particles and without seeding; and a subsequent second step of crystalline growth achieved by controlled cooling while maintaining supersaturation of the product.

8. The method according to claim 7, wherein the first step comprises cooling a saturated solution of hexogen in acetone.

9. The method according to claim 8, wherein the saturated solution of hexogen in acetone is cooled at a rate of 1 deg. C./min in the first step.

10. The method according to claim 9, wherein the saturated solution of hexogen in acetone is cooled from a temperature of 50 deg. C. to a temperature of 44 deg. C. in the first step.

11. The method according to claim 7, wherein, during the second step, a temperature T approximately follows a following equation as a function of the time t, expressed in seconds:

$T=T0-T1(t/3,600)^3$, where T0 is a starting temperature and T1 is a difference between the starting temperature and a final temperature.

12. The method according to claim 11, wherein a saturated solution of hexogen in acetone is cooled from a starting temperature of 44 deg. C. to a final temperature of 20 deg. C. during the second step.

13. The method according to claim 7, wherein preparing the crystalline nitramine particles comprises a third step of filtrating the explosive crystalline nitramine particles obtained.

14. The method according to claim 6, wherein rounding the crystalline nitramine particles comprises a mechanical erosion combined with partial dissolving of the crystalline nitramine particles.

15. The method according to claim 14, wherein the crystalline nitramine particles are particles of hexogen and partial dissolving is carried out in cyclohexanone.

16. The particles of nitramine according to claim 2, wherein the rounded shape is a sphere, a capsule or a pebble.

17. A method for preparing explosive nitramine particles, comprising:

a first step of nucleation in order to initiate a crystallization process;

a second step of crystal growing achieved by a control cooling in order to maintain supersaturation to a low constant level in order to obtain the explosive nitramine particles in crystalline form that comprise a volume fraction of closed pores of less than or equal to 0.05%; and a third and last step of rounding the explosive nitramine particles.

18. The method according to claim 17, wherein the first step of nucleation is achieved without seeding by a controlled cooling of a saturated solution of a product suitable for nucleus formation.

* * * * *